US010849412B2

(12) United States Patent
Heward et al.

(10) Patent No.: US 10,849,412 B2
(45) Date of Patent: Dec. 1, 2020

(54) LEAK-PROOF BAG WITH FOLDING CLOSURE

(71) Applicants: Cory Heward, Pleasant Grove, UT (US); Ryan Badger, Pleasant Grove, UT (US)

(72) Inventors: Cory Heward, Pleasant Grove, UT (US); Ryan Badger, Pleasant Grove, UT (US)

( * ) Notice: Subject to any disclaimer, the term of this patent is extended or adjusted under 35 U.S.C. 154(b) by 0 days.

(21) Appl. No.: 16/236,888

(22) Filed: Dec. 31, 2018

(65) Prior Publication Data

US 2019/0200737 A1 Jul. 4, 2019

Related U.S. Application Data

(60) Provisional application No. 62/612,189, filed on Dec. 29, 2017.

(51) Int. Cl.
*A45F 3/20* (2006.01)
*A45F 3/16* (2006.01)

(52) U.S. Cl.
CPC ..... *A45F 3/20* (2013.01); *A45F 2003/166* (2013.01)

(58) Field of Classification Search
CPC ..... A41B 1/00; A45F 3/16
See application file for complete search history.

(56) References Cited

U.S. PATENT DOCUMENTS 3,251,390 A * 5/1966 Evans ..... A61M 3/0245 383/17
4,948,023 A * 8/1990 Tripp ..... A45F 3/16 222/175
5,085,349 A * 2/1992 Fawcett ..... A45F 3/20 220/703
5,282,557 A * 2/1994 McCook ..... A45F 3/16 222/175
5,566,869 A * 10/1996 Katz ..... A45F 3/16 137/516.11
5,803,333 A * 9/1998 Fawcett ..... A45F 3/00 224/148.2
5,806,726 A * 9/1998 Ho ..... B62J 11/00 222/107
5,913,456 A * 6/1999 Dikeman ..... B62J 99/00 222/105
5,938,089 A * 8/1999 Abreu-Marston ..... A45F 3/20 215/382
5,940,880 A * 8/1999 Phillips ..... A42B 3/048 2/181
5,941,640 A * 8/1999 Thatcher ..... A45F 3/20 383/22

(Continued)

*Primary Examiner* — Brian D Nash

(57) ABSTRACT

Disclosed herein are embodiments for a leak-proof hydration bladder with an improved opening and folding closure mechanism. Embodiments include an opening on a top side of the bladder and a closed bottom side. A strap is attached to a first side of the bladder and extends to a second side opposite. The strap has a closure mechanism that attaches to a second side of the bladder. The bladder includes a hose with access to an inside of the bladder for consumption of its contents. The bladder is made of a plastic material that maintains a substantially leak-proof seal when the bladder is folded from the top and the closure mechanism is closed.

8 Claims, 7 Drawing Sheets

(56) References Cited

U.S. PATENT DOCUMENTS

| | | | | |
|---|---|---|---|---|
| 6,247,619 | B1 * | 6/2001 | Gill | A45F 3/20 222/105 |
| 6,267,506 | B1 * | 7/2001 | Campion | A45C 11/22 224/148.2 |
| 6,409,048 | B1 * | 6/2002 | Belzeski | A45F 3/04 222/103 |
| 6,415,960 | B1 * | 7/2002 | Fink | B67D 3/00 222/175 |
| 6,422,439 | B1 * | 7/2002 | Kelliher | A45F 3/04 190/110 |
| 6,598,770 | B2 * | 7/2003 | Bolts | A45F 3/00 224/148.2 |
| 6,644,854 | B2 * | 11/2003 | Lien | A45F 3/20 222/175 |
| 8,833,619 | B2 * | 9/2014 | Chapuis | A45F 3/04 224/148.2 |
| 9,591,911 | B2 * | 3/2017 | Hopmeier | A45F 3/16 |
| 2002/0124294 | A1 * | 9/2002 | McKenzie | A41D 13/0002 2/69 |
| 2004/0065703 | A1 * | 4/2004 | Bellucci | A45F 3/20 224/148.5 |
| 2019/0059562 | A1 * | 2/2019 | Escava | A45F 3/04 |
| 2019/0291621 | A1 * | 9/2019 | Dougherty | B62J 9/008 |

* cited by examiner

LEAK-PROOF BAG WITH FOLDING CLOSURE

BACKGROUND

Technical Field

Embodiments generally relate to reusable leak-proof bags.

Background

Portable hydration packs are popular for outdoor recreational activities, such as hiking, camping, music festivals, etc. A hydration pack is a type of hydration system, typically built as a backpack or waistpack containing a reservoir or "bladder" commonly made of rubber or plastic. Typical reservoirs may contain a capped mouth for filling with liquid and a hose for drinking or emptying the contents of the pack. Hydration packs can be a convenient means of carrying liquids over long periods of time and distances. Some field backpacks are designed to include accommodations for receiving and securing a hydration bladder.

SUMMARY

Disclosed herein are embodiments for a leak-proof hydration bladder with an improved opening and folding closure mechanism. Embodiments include an opening on a top side of the bladder and a closed bottom side. A strap is attached to a first side of the bladder and extends to a second side opposite. The strap has a closure mechanism that attaches to a second side of the bladder. The bladder includes a hose with access to an inside of the bladder for consumption of its contents. The bladder is made of a plastic material that maintains a substantially leak-proof seal when the bladder is folded from the top and the closure mechanism is closed.

The embodiments disclosed above are only examples, and the scope of this disclosure is not limited to them. Particular embodiments may include all, some, or none of the components, elements, features, functions, operations, or steps of the embodiments disclosed above. Embodiments according to the invention are in particular disclosed in the attached claims directed to a method, a storage medium, a system and a computer program product, wherein any feature mentioned in one claim category, e.g. method, can be claimed in another claim category, e.g. system, as well. The dependencies or references back in the attached claims are chosen for formal reasons only. However any subject matter resulting from a deliberate reference back to any previous claims (in particular multiple dependencies) can be claimed as well, so that any combination of claims and the features thereof are disclosed and can be claimed regardless of the dependencies chosen in the attached claims. The subject-matter which can be claimed comprises not only the combinations of features as set out in the attached claims but also any other combination of features in the claims, wherein each feature mentioned in the claims can be combined with any other feature or combination of other features in the claims. Furthermore, any of the embodiments and features described or depicted herein can be claimed in a separate claim and/or in any combination with any embodiment or feature described or depicted herein or with any of the features of the attached claims.

BRIEF DESCRIPTION OF THE DRAWINGS

The accompanying drawings are incorporated herein and form a part of the specification.

DETAILED DESCRIPTION

Figure 1:
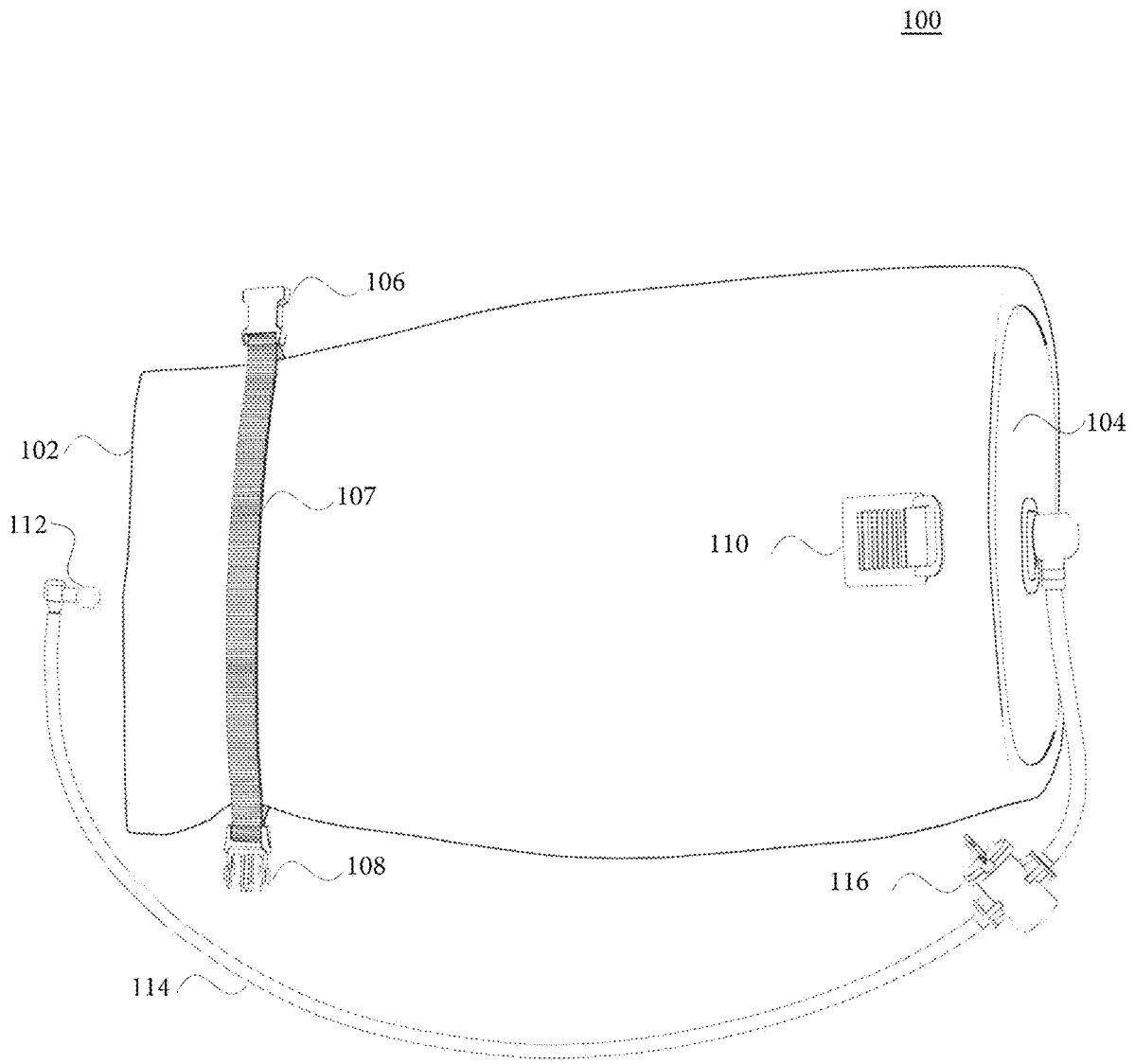
FIG. 1 shows a back view of a leak-proof bladder, according to an example embodiment.
Figure 2:
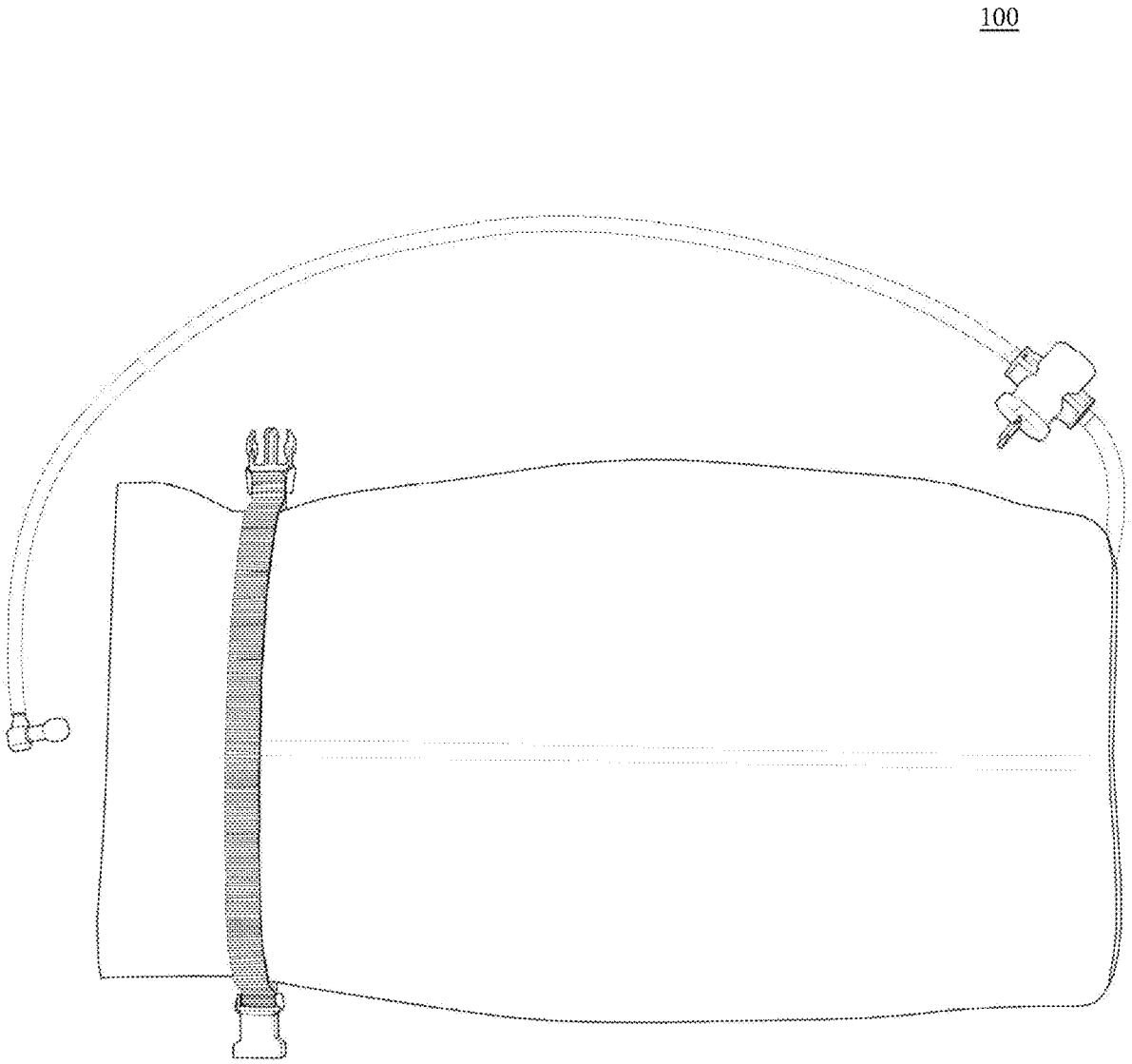
FIG. 2 shows a front view of a leak-proof bladder, according to an example embodiment.
Figure 3:
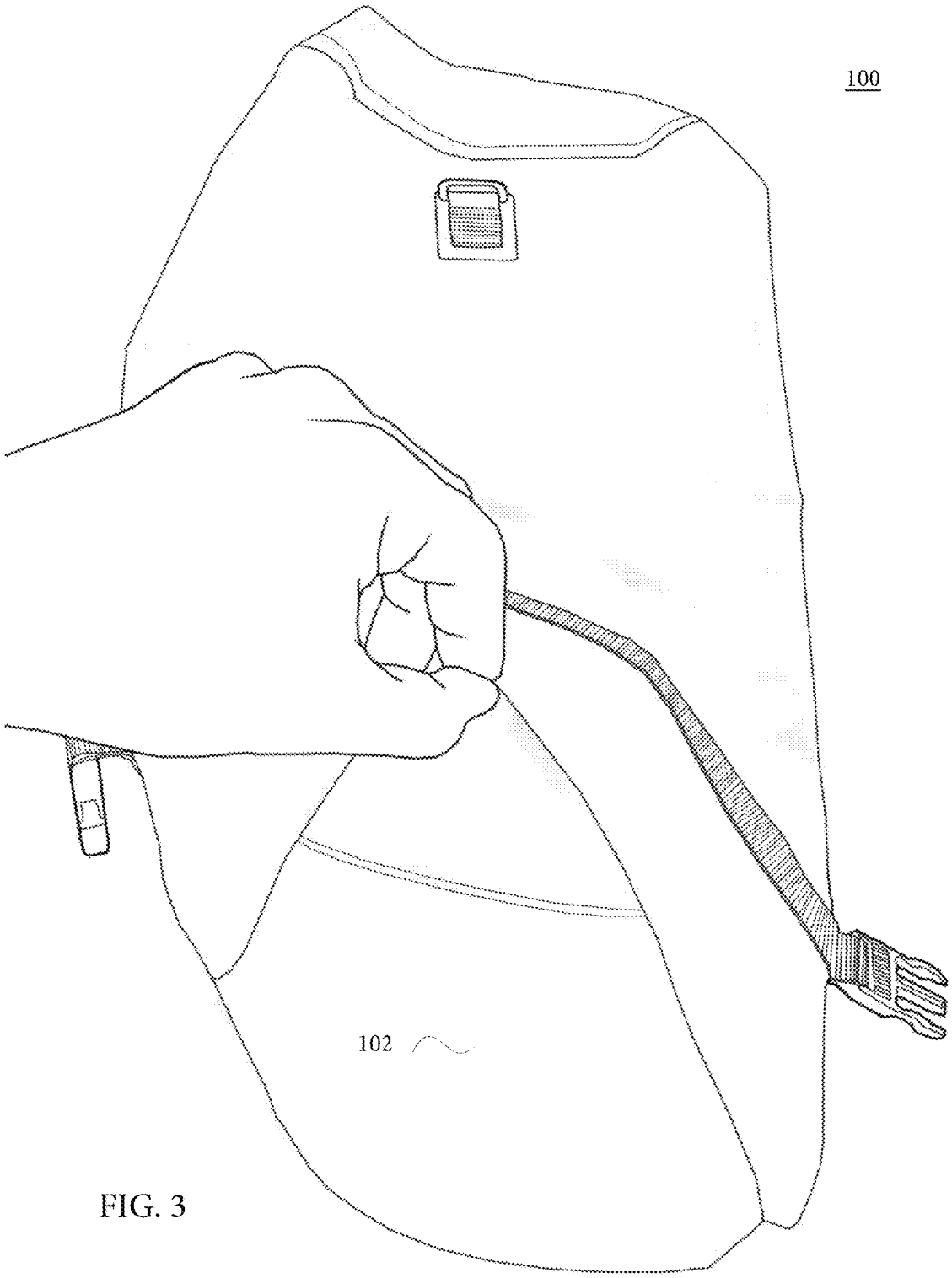
FIG. 3 shows a top opening of a leak-proof bladder, according to an example embodiment.
Figure 4:
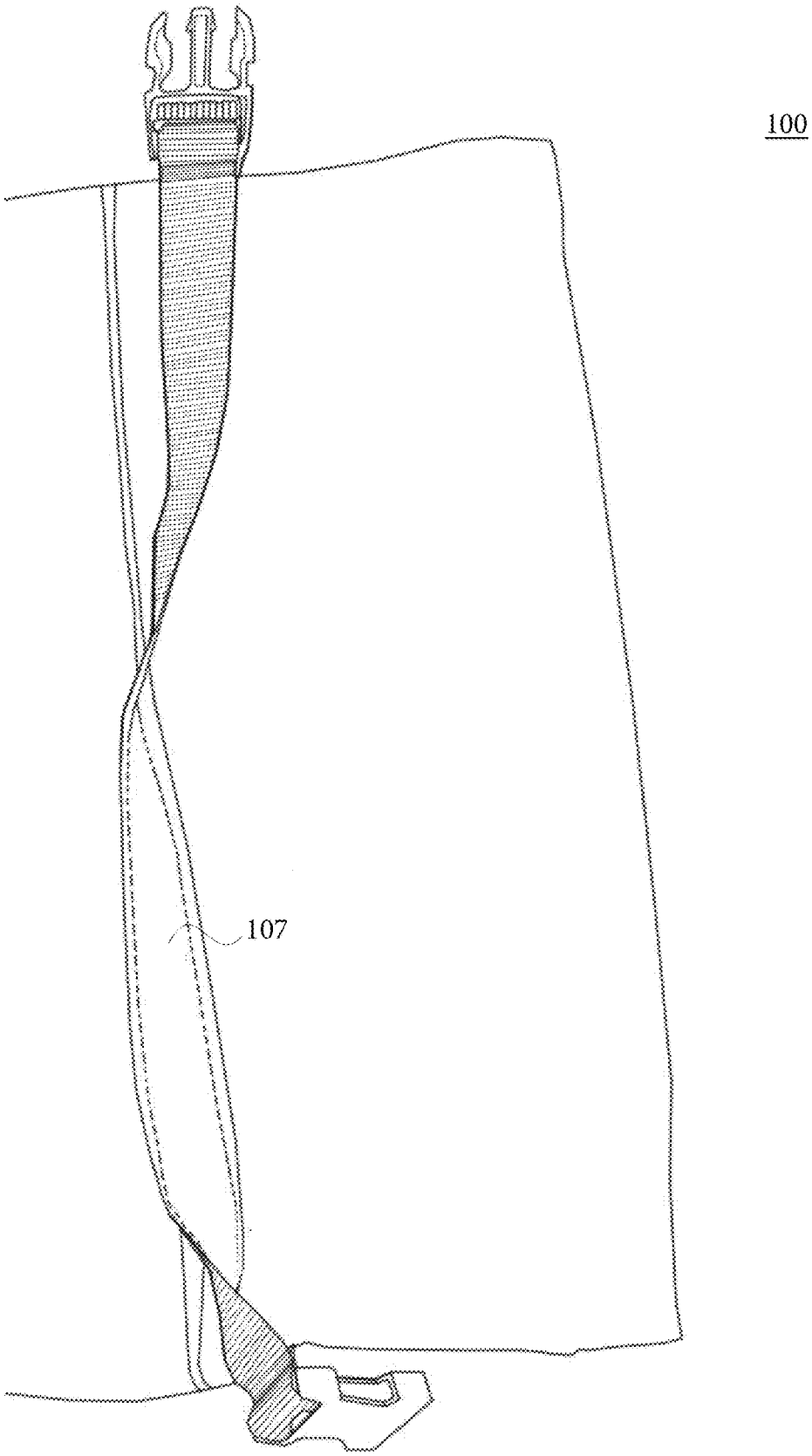
FIG. 4 shows a strap attached to a leak-proof bladder, according to an example embodiment.
Figure 5:
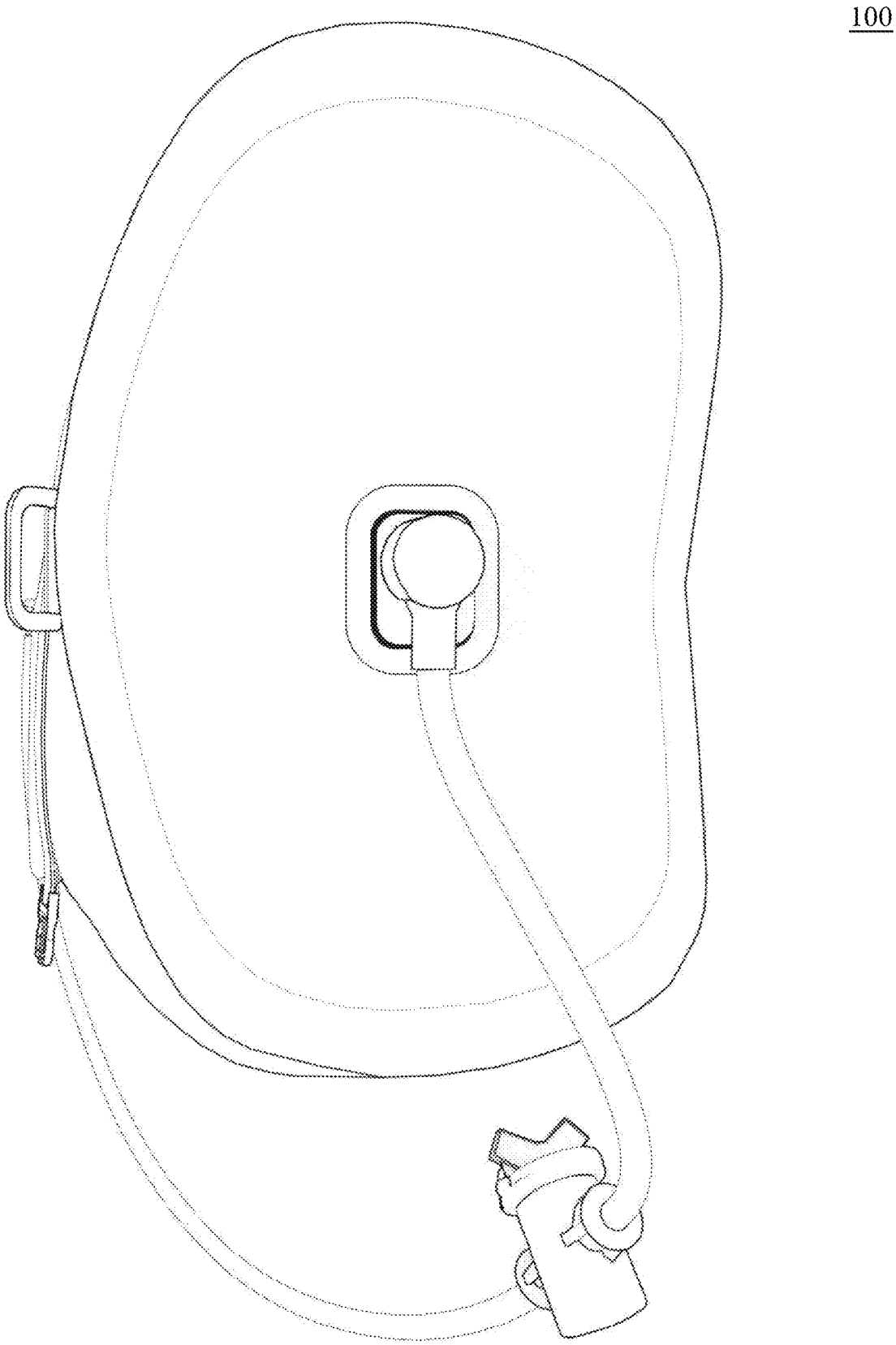
FIG. 5 shows a bottom view of a leak-proof bladder, according to an example embodiment.

Provided herein are product embodiments for a leak-proof hydration bladder with an improved opening and folding closure mechanism.

While the embodiments described herein are exemplified in the context of a hydration pack, they are generally applicable to any leak-proof liquid storage product.

FIGS. 1-7 illustrate a leak-proof hydration bladder 100 from various angles, according to an example embodiment. Bladder 100 comprises an opening 102 and a bottom portion 104. Bladder 100 may be made of one or more sheets of flexible plastic material stitched together to form bag shape, such as, for example, the shape shown in FIGS. 1-7. The stitching may be performed using any suitable leak-proof method for stitching together plastics, such as using adhesive, heat bonding, etc. In particular embodiments, two ends of a single sheet are stitched together to form a cylindrical or quasi-cylindrical shape, and one end of the cylinder is stitched to a second sheet forming bottom portion 104. In other embodiments, two or more sheets of plastic are stitched together to form the cylindrical or quasi-cylindrical shape. Bottom portion 104 may allow for the bag to stand up-right when contents are placed inside the bag.

Opening 102 comprises a wide-mouth opening, such as those found in an ordinary bag. Opening 102 may allow for quickly and efficiently inserting large amount of liquids or solids, such as ice or ice cubes. In particular embodiments, bladder 100 and opening 102 are large enough to accommodate a commercial bag of ice (e.g., a 5 lbs. bag of ice, etc.). The plastic material may be any flexible plastic material suitable for closing the bladder as will be described herein. In particular embodiments, the plastic material may be food-grade material for allowing persons to consume food or liquids directly from the bladder. As an example, the plastic material may comprise polyethylene, polycarbonate, or any suitable composite or compound that can be folded and maintain a substantially leak-proof seal as described herein.

Bladder 100 further comprises a closure mechanism 107. As an example, closure mechanism 107 may comprise a strap extending parallel to the opening 102 and including closing means, such as quick release clip-on buckles 106, 108, as shown in FIGS. 1-7. In another example, the strap may be attached or stitched to one side of the bladder with a first closure end, and a second closure end may be attached to the opposite side of the bladder. While clip-on buckles are shown in the example embodiment of FIGS. 1-7, any suitable means of closure may be used, such as, by way of example, hook-and-loop fasteners (e.g., Velcro®), bar buckles, d-ring buckles, turn clasps, magnetic clasps, etc.

Figure 6:
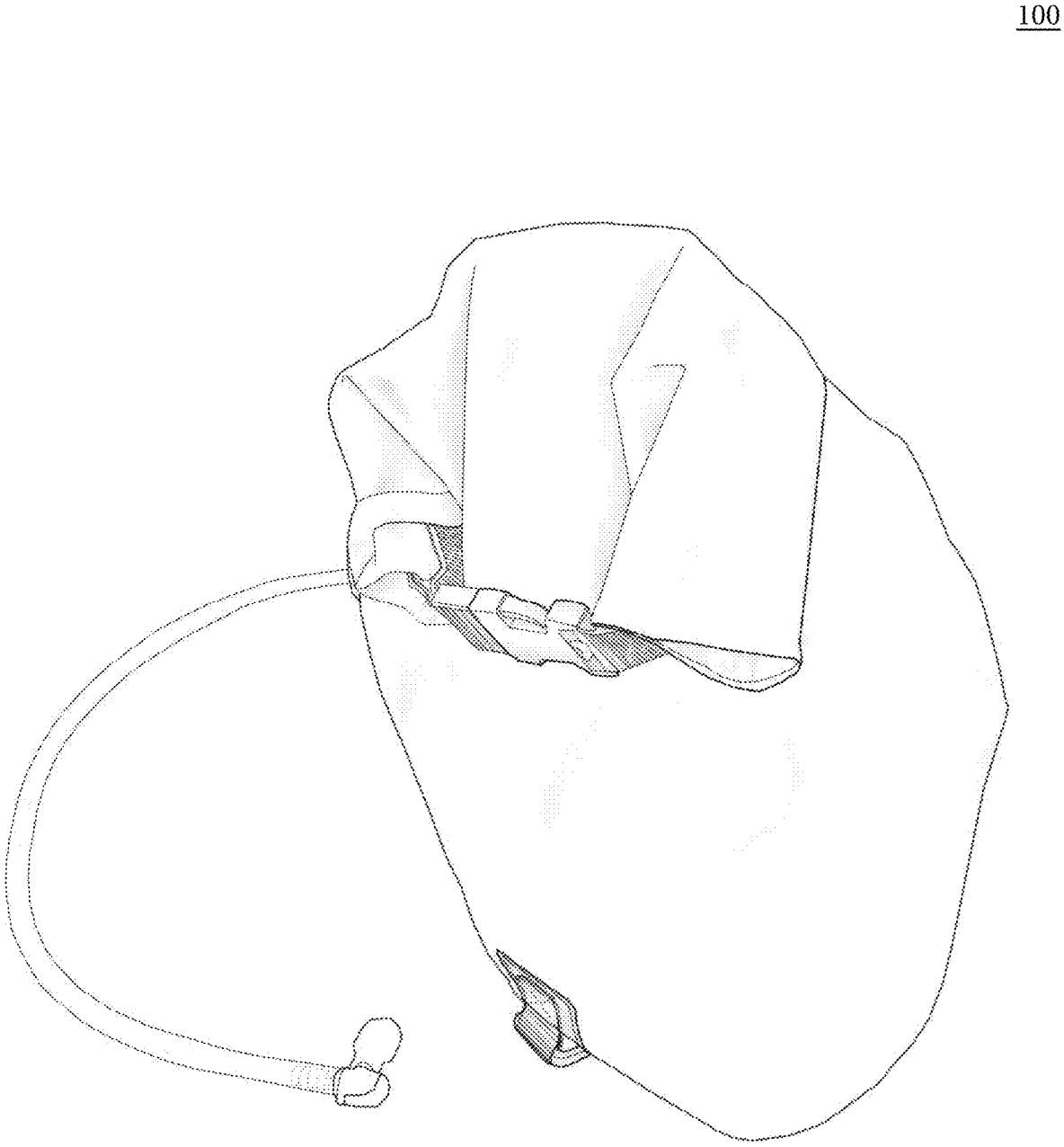
FIG. 6 shows a perspective view of a leak-proof bladder with the top opening twice folded and the closure mechanism closed, according to an example embodiment.
Figure 7:
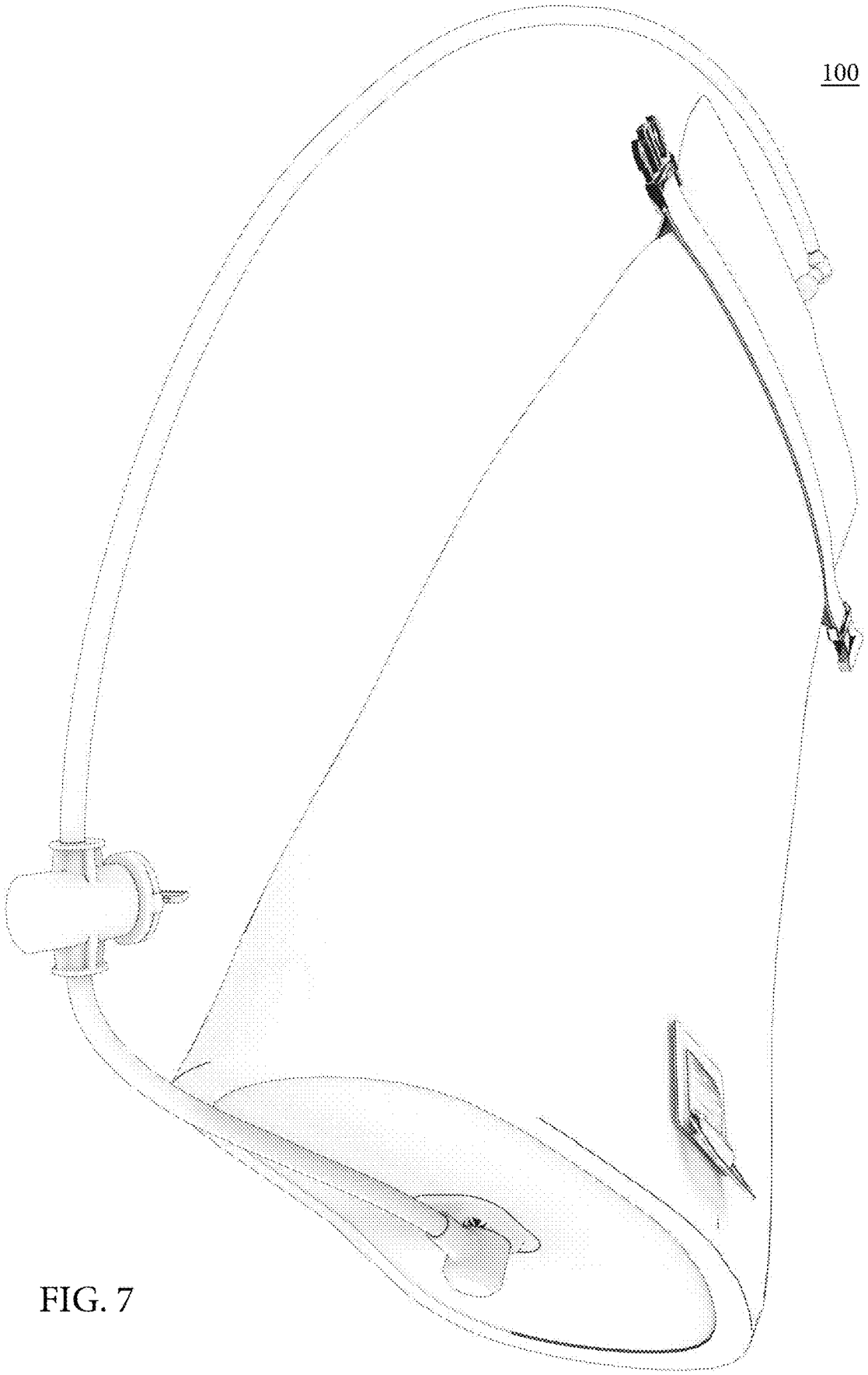
FIG. 7 shows a perspective view of a leak-proof bladder, according to an example embodiment.

Bladder 100 may be operable to maintain a leak-proof or substantially leak-proof seal when the bladder is folded from the top and closure mechanism 107 is closed. As an example, bladder 100 may be positioned with opening 102 facing up and bottom portion 104 facing down. The bladder may then be folded two or more times from the top down, and the closure mechanism may be closed around the top, as illustrated in FIG. 6. Closure mechanism 107 creates contact between the folded portions of plastic material adjacent to opening 102, which in combination with inward pressure of the contents creates a leak-proof or quasi-leak-proof seal. When closure mechanism 107, such as the strap shown in FIGS. 1-7, is closed around the folded top, it transfers the inner pressure of the bladder to the outer sheets of the fold. This squeezes together the folded sheets and thus increases the strength of the seal the more the interior of the bag is pressurized.

In particular embodiments, bladder 100 may further include a hose 114 for consuming or emptying the contents of the bladder. Hose 114 may include a mouthpiece 112 for consuming the contents and a valve 116 for controlling the flow of liquid through the tube. In particular embodiments, mouthpiece 112 may be a bite valve that allows liquid to pass when squeezed or bitten. In particular embodiments, mouthpiece 112 may comprise a bit valve with an integrated ball valve for controlling the flow of liquid through the mouthpiece. While particular hose, mouthpiece and valve combinations have been described, any suitable hose, mouthpiece, and valve combination is contemplated.

Bladder 110 may further include a coupling mechanism 110 for securing the bag to a carrying container or backpack. The coupling mechanisms may be a loop as shown in FIG. 1-7 with references to elements 110, but may also be any suitable means of coupling, such as buckles, fasteners, etc.

While the invention has been described herein with reference to exemplary embodiments for exemplary fields and applications, it should be understood that the invention is not limited thereto. Other embodiments and modifications thereto are possible, and are within the scope and spirit of the invention. Further, embodiments (whether or not explicitly described herein) have significant utility to fields and applications beyond the examples described herein.

Embodiments have been described herein with the aid of functional building blocks illustrating the implementation of specified functions and relationships thereof. The boundaries of these functional building blocks have been arbitrarily defined herein for the convenience of the description. Alternate boundaries can be defined as long as the specified functions and relationships (or equivalents thereof) are appropriately performed.

References herein to "one embodiment," "an embodiment," "an example embodiment," or similar phrases, indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it would be within the knowledge of persons skilled in the relevant art(s) to incorporate such feature, structure, or characteristic into other embodiments whether or not explicitly mentioned or described herein.

What is claimed is:

1. A leak-proof bladder, the bladder comprising:

an opening on a top side of the bladder;

a closed bottom side of the bladder;

a strap attached to at least a first side of the bladder and extending to a second side opposite to the first side, the strap having at least a first end of a closure mechanism, wherein the strap is stitched to the bladder in a loop around the bladder parallel to the opening;

a second end of the closure mechanism attached to the second side of the bladder, wherein the first and second ends are removably coupled to close the mechanism; and a hose connected to the bladder with access to an inside of the bladder, wherein the bladder is made of a plastic material that maintains a substantially leak-proof seal when the bladder is folded from the top and the closure mechanism is closed.

2. The bladder of claim 1, wherein the plastic material comprises polyethylene or polycarbonate.

3. The bladder of claim 1, wherein the strap has both the first and second ends of the closure mechanism.

4. The bladder of claim 1, wherein the closure mechanism comprises at least one of a clip-on buckle, a hook-and-loop fastener, a bar buckle, a d-ring buckle, a turn clasps or a magnetic clasp.

5. The bladder of claim 1, wherein the hose comprises a valve for controlling the flow of liquid and a mouthpiece for consuming contents of the bladder through the hose.

6. The bladder of claim 5, wherein the valve comprises a bite valve integrated to the mouthpiece that allows liquid to pass when squeezed.

7. The bladder of claim 6, wherein the bite valve comprises a ball valve integrated into the mouthpiece.

8. The bladder of claim 1, the bladder further comprising a coupling mechanism for securing the bag to a carrying container.

* * * * *